US010293311B2

(12) United States Patent
Linne et al.

(10) Patent No.: US 10,293,311 B2
(45) Date of Patent: May 21, 2019

(54) MIXING ELEMENT FOR A STATIC MIXER

(71) Applicant: Sulzer Mixpac AG, Haag (CH)

(72) Inventors: Volker Linne, Rosenthal (DE); Sasan Habibi-Naini, Rikon (CH)

(73) Assignee: SULZER MIXPAC AG, Haag (CH)

( * ) Notice: Subject to any disclaimer, the term of this patent is extended or adjusted under 35 U.S.C. 154(b) by 510 days.

(21) Appl. No.: 13/687,804

(22) Filed: Nov. 28, 2012

(65) Prior Publication Data

US 2013/0135963 A1 May 30, 2013

(30) Foreign Application Priority Data

Nov. 29, 2011 (EP) ..... 11191143

(51) Int. Cl.
*B01F 5/06* (2006.01)
*B01F 13/00* (2006.01)
*B05C 17/005* (2006.01)

(52) U.S. Cl.
CPC ..... *B01F 5/0604* (2013.01); *B01F 5/0618* (2013.01); *B01F 5/0641* (2013.01); *B01F 13/002* (2013.01); *B01F 2215/0027* (2013.01); *B01F 2215/0029* (2013.01); *B05C 17/00553* (2013.01)

(58) Field of Classification Search
CPC ..... B01F 5/061; B01F 5/0618; B01F 5/0641; B01F 2005/0625; B01F 2005/0626; B01F 5/0604
USPC ..... 366/336, 337
See application file for complete search history.

(56) References Cited

U.S. PATENT DOCUMENTS 4,538,920 A 9/1985 Drake
5,487,606 A 1/1996 Keller
5,498,078 A 3/1996 Keller
6,135,631 A 10/2000 Keller
6,530,685 B1 * 3/2003 Muhlbauer et al. ..... 366/336
(Continued)

FOREIGN PATENT DOCUMENTS

CH 699 958 A1 5/2010
DE 295 22 199 U1 8/2000
(Continued)

OTHER PUBLICATIONS

European Search Report for European Patent Application No. 11191143.4-2307 dated Apr. 25, 2012.

*Primary Examiner* — Marc C Howell
(74) *Attorney, Agent, or Firm* — Global IP Counselors, LLP

(57) ABSTRACT

A mixing element for a static mixer for installation into a tubular mixer housing has a longitudinal axis along which at least one first and one second installation body are arranged behind one another. An inlet element is provided which is arranged upstream of the first installation body, wherein the inlet element and the first installation body are connected to one another via a connection element. The inlet element has a body which can be sealingly taken up at the peripheral side in the mixer housing. The body has a first inlet passage and a second inlet passage, wherein the first inlet passage has a first entry opening and a first exit opening, wherein the second inlet passage has a second entry opening and a second exit opening so that the corresponding component can be conducted through the corresponding inlet passage.

16 Claims, 8 Drawing Sheets

(56) References Cited

U.S. PATENT DOCUMENTS

| | | | |
|---|---|---|---|
| 6,837,612 | B2 | 1/2005 | Bublewitz et al. |
| 7,325,970 | B2 | 2/2008 | Keller |
| 7,841,765 | B2 | 11/2010 | Keller |
| 2003/0123323 | A1 | 7/2003 | Bublewitz et al. |
| 2004/0141413 | A1 | 7/2004 | Keller |
| 2005/0047274 | A1 | 3/2005 | Moser et al. |
| 2006/0187752 | A1 | 8/2006 | Keller |
| 2006/0245299 | A1 | 11/2006 | Heusser et al. |
| 2008/0232191 | A1 | 9/2008 | Keller |
| 2010/0097883 | A1 | 4/2010 | Habibi-Naini |
| 2011/0228631 | A1 | 9/2011 | Stoeckli et al. |

FOREIGN PATENT DOCUMENTS

| | | | |
|---|---|---|---|
| DE | 101 64 385 | C1 | 3/2003 |
| DE | 20 2006 015 457 | U1 | 2/2008 |
| EP | 0 584 428 | A1 | 3/1994 |
| EP | 0 723 807 | A2 | 7/1996 |
| EP | 0 885 651 | A1 | 12/1998 |
| EP | 1 426 099 | A1 | 6/2004 |
| JP | 59-166232 | A | 9/1984 |
| JP | 08-066627 | A | 3/1996 |
| JP | 08-276125 | A | 10/1996 |
| JP | 09-136023 | A | 5/1997 |
| JP | 11-099325 | A | 4/1999 |
| JP | 2000-317287 | A | 11/2000 |
| JP | 2003-275556 | A | 9/2003 |
| JP | 2004-188415 | A | 7/2004 |
| JP | 2010-094999 | A | 4/2010 |
| WO | 2008113196 | A1 | 9/2008 |

* cited by examiner

MIXING ELEMENT FOR A STATIC MIXER

PRIORITY CLAIM

The present application claims priority to European Patent Application No. 11191143.4 filed on Nov. 29, 2011, the disclosure of which is incorporated herein by reference.

BACKGROUND

The invention relates to a mixing element for a static mixer of plastic including an installation body for installation into a tubular mixer housing. Such a mixer as well as the associated mixer housing can be connected to the outlets of a multicomponent cartridge as in WO 2008/113196 A1 and can in their totality represents a cartridge arrangement as is shown in FIG. 2 of WO 2008/113196 A1.

The mixing element, in particular its installation body, has a longitudinal axis which is aligned in the direction of a fluid flowing into the installation body so that a mixing space can be spanned by the installation body in the inner space of the mixer housing. The mixing space has a cross-sectional flow area in a plane normal to the longitudinal axis which essentially corresponds to the cross-sectional flow area of the tubular mixer housing. The installation body includes a wall element for the division and/or deflection of the fluid flow into a direction deviating from the longitudinal axis.

Such a static mixer is, for example, known from EP 1 426 099 B1. In this static mixer, two components are mixed with one another by means of a plurality of mixing elements of the same type in a three-part mixing process in which the material is first divided, then spread and displaced. This mixing process has to be carried out several times depending on the physical properties of the components. For this reason, the static mixer contains a plurality of installation bodies of the same construction arranged behind one another. These mixers are in particular used for the mixing of small quantities of the components, that is a few milliliters up to approximately 1,000 milliliters. Accordingly, these mixers have a mixing space with a diameter of less than 16 mm with a length of more than 50 mm. This has the consequence that the wall thicknesses of the wall elements of this mixer can amount to less than 1 mm, often even less than 0.5 mm.

Such a static mixer in accordance with EP 1 426 099 B1 of plastic is preferably manufactured in an injection molding process. The manufacture of a mixer of 30 mm length with a wall thickness of less than 3 mm using the injection molding process, as shown in FIG. 1 of this patent, was previously not possible since the flow path from the injection point of the injection molding tool up to the oppositely disposed end of the mixer would require internal tool pressures which are too high. To be able to manufacture a static mixer having such small wall thicknesses economically in the injection molding process, each installation body is connected to the adjacent installation body via bar elements. These bar elements allow the polymer melt in the injection molding tool to move from one installation body to an adjacent installation body and to maintain the inner tool pressures below 1000 bar so that a failure of the injection molding tool can be prevented. It must be noted that an inlet element is interposed before the installation bodies. The inlet element contains the two inlet passages which introduce the components from the cartridge outlets into the mixer housing. The mixing element contains installation bodies. The components are deflected, divided and recombined by the installation bodies, whereby a mixing of the components takes place. The components are thus present as a uniformly mixed filler material at the outlet end.

The mixer of WO 2008/113196 A1 has a configuration in accordance with which a lead of one component is prevented in that a constriction is provided in the flow passage, that is a restriction effect is deliberately installed. FIG. 13 of WO 2008/113196 A1 shows that a bar element is provided for this purpose in the inlet region of the mixer adjoining its inlet passage, said bar element forming a flow obstruction and providing the deflection of the flow around this bar element. The component flowing at the left side thus has a longer flow path imposed on it than the component flowing at the right side. In accordance with another embodiment which is shown in EP 0 885 651, a separation bar is provided over each of the two inlet openings. This separation bar is flowed around by the component flowing through the corresponding inlet opening. The volume flows of the two components also differ in this embodiment. The first component having the larger volume flow is guided adjoining the separation bar by bar elements parallel to the outer surface of the adapter element in the direction of the inlet opening of the second component. The second component which has a smaller volume flow is taken up by the first component and brought into contract even before the entry into the mixing element. This means that the first component having the larger volume flow reaches the mixer with a delay in relation to the second component, that is its flow is delayed by an additional path length.

In the document EP 0 723 807 A2, a variant is shown in accordance with which the inlet chambers have different volumes when the components are present in a mixing ratio not equal to 1:1. These inlet chambers take up the components conveyed from the cartridge before they enter into the mixing element. The inlet chamber of the first component which forms the larger volume flow has a larger volume than the inlet chamber of the second component which forms the smaller volume flow. When the first component thus moves into the inlet chamber, the inlet chamber is first completely filled before the component reaches the first mixing element of the static mixer. The second component simultaneously flows through the second inlet chamber which has a substantially smaller volume. The volume ratio can thus be set such that the first component and the second component reach the first mixing element simultaneously.

The component which has a higher volume share is also dammed in accordance with EP 0 584 428. The flow path is interrupted by a plate at the inlet of the static mixer for this purpose. A slit-like opening is provided in this plate through which the components which have filled up the reservoir space disposed in front of it move into the static mixer. A lead of the component having the larger volume flow is hereby suppressed.

It can thus be said in a generalizing manner that the volumes which are located between the cartridge and the mixer should be adapted to the corresponding mixing ratios in order to be given as little a lead as possible to avoid material being obtained mixed in an unusable manner. The first approach is therefore to adapt the cross-sectional areas of the feed lines in accordance with the desired mixing ratio. If, however, very different mixing ratios are present, the cross-sectional area for the component having the smaller volume flow can, however, no longer be manufactured. An additional volume, for example an inlet chamber as described in EP 0 723 807 A2 or a chamber at the inlet end of the mixing element as described in EP 0 584 428 A1, is therefore provided to the component having the larger volume flow.

SUMMARY

It is the object of the invention to provide a mixing element in which each of the two components reaches the first installation body of the mixing element in the desired mixing ratio. It is in particular the object of the invention to reduce a lead of a component with respect to the other component. The leading component reaches the mixing element before the other component. A further object of the invention is to reduce the pressure loss in comparison with already known solutions which likewise have the problems of a lead.

The object of the invention is satisfied by a mixing element which contains at least one installation body as well as an inlet element which has a body having a first and a second inlet passage. The corresponding components are conducted to the installation body separately from one another by the inlet passages. A first and a second installation body can in particular be arranged behind one another along the longitudinal axis of the mixing element.

The inlet element is arranged upstream of the first installation body, with the inlet element and the installation body being connected to one another via a connection element. The connection element can be a helical element of a helical mixer which is simultaneously its installation body or a bar element which is a part of the first installation body. The body of the installation element can be sealingly taken up in the mixer housing at the peripheral side. Each of the first inlet passages and of the second inlet passages has an entry opening and an exit opening so that the corresponding component can be conducted through the corresponding inlet passage from the entry opening to the exit opening. The first inlet passage extends spatially separately from the second inlet passage. The first inlet passage opens into a pre-chamber, with the pre-chamber being bounded by the outlet side of the body, by the connection element, by the inner wall of the mixer housing and by the first installation body, with the second passage extending within the inner space of the connection element and opening from the connection element into the first installation body.

The ratio of the remaining free cross-sectional area and of the cross-sectional area of the continuation passage in a sectional plane which is disposed normal to the longitudinal axis and is arranged at the mixer inlet is at least 4:1. The mixing ratio of the components can be 4:1, but also at least 5:1 in accordance with an alternative embodiment; it can also amount to at least 10:1 or even above this. A mixing element having the same dimensions is preferably used for all mixing ratios of the components. The following additional geometrical conditions thus apply in an analog manner to cross-sectional ratios of 5:1 to 10:1 or more. "At least 4:1" is in this respect intended to mean ratios of 4:1, 5:1, 6:1, 10:1, 20:1 as well as also ratios disposed therebetween or ratios which are above this. The mixer housing in accordance with an embodiment has a step on which the outlet side of the body lies. The sectional plane can in particular be arranged between this step and the first installation body.

Directly adjoining the exit opening, the cross-sectional area ratio of the cross-sectional areas available for the components at this point can amount to at least 5:1. The ratio of the cross-sectional areas of the entry openings is at least 5:1.

The cross-sectional area of the inlet opening to the cross-sectional area adjoining the outlet opening increases by at least double for at least one of the components. The cross-sectional area from the inlet opening to the cross-sectional area adjoining the outlet opening for each of the components in particular increases by at least double.

The installation bodies can in this respect be designed as helical mixers, with each helix being able to considered as an installation body. The helix is a bar element which is twisted by an angle about its longitudinal axis. The angle can amount to 90°, for example. An adjacent helix is then a further installation body. The helices can be arranged at an angular offset to one another; adjacent helices can in particular be arranged offset to one another by an angle of 90°. Alternatively, the installation bodies of such a mixing element can be connected to one another via a common bar element.

In accordance with an embodiment, the second inlet passage narrows in the inner space of the connection element. The flow speed of the second component which flows through this second inlet passage in the operating state can be increased by this constriction. The second component can in particular be admixed in a smaller amount than the first component flowing through the first inlet passage. It is ensured by the constriction that the second component already enters into the static mixer with the first component in the correct mixing ratio at the start of the dispensing process.

The second inlet passage has an inner diameter in the inner space of the connection element which reduces continuously from the inlet side to the outlet side. When the inner diameter continuously reduces, the increase in the flow speed can take place with minimal losses, that is a maximum increase of the flow speed can be reached.

The mixing element is provided for a static mixer for installation in a tubular mixer housing. The mixing element has a longitudinal axis along which a plurality of installation bodies are arranged behind one another, with a first installation body having a first wall element which extends in the direction of the longitudinal axis. The wall element has a first side wall and a second side wall which is arranged opposite the first side wall. The first wall element in particular forms the connection element. A guide element can be arranged adjacent to the first wall element. The guide element can serve to extend the flow path of the first component or to delay the inflow of the first component into the mixing element. The guide element can be formed as a deflection element or it can be formed as a part of this deflection element. The deflection element has a deflection surface extending in the transverse direction to the wall element at both sides of the wall element, with a first opening being provided in the deflection surface at the side which faces the first side wall of the wall element. The deflection element can in particular at least partly cover the first exit opening.

In accordance with a further embodiment, the first inlet passage can have a cross-sectional area at the respective exit opening which differs from the cross-sectional area of the corresponding exit opening of the second inlet passage. The cross-sectional area of the first inlet passage is in particular larger at the first exit opening than the cross-sectional area of the second exit opening of the second inlet passage.

In accordance with an embodiment, a second and third wall element are arranged adjacent to the first opening, with the second and third wall elements extending in the direction of the longitudinal axis and each having an inner wall and an outer wall which extend substantially in the direction of the longitudinal axis. Each of the inner walls and outer walls include an angle between 20° and 160° with the first or second side wall of the first wall element. The first opening is arranged between the inner walls of the second and third wall elements and a second opening is arranged outside one of the outer walls of the second or third wall elements, with the second opening being provided in the deflection surface at the side which faces the second side wall of the first wall element. A second and a third wall element are thus arranged opposite the first wall element adjacent to the first opening in the direction of the longitudinal axis, with the second and third wall elements bounding a passage starting from the first opening and extending in the direction of the longitudinal axis. A second opening is provided in the deflection surface at the side which faces the second side wall of the wall element, with the second or third wall elements adjoining the second opening. Furthermore, the first wall element of the second installation body adjoins the second and third wall elements. It has proved to be particularly advantageous if more than five installation bodes are connected to one another via a common bar element because the pressure loss is surprisingly smaller than without common bar elements.

The second installation body can in particular also have a first wall element which extends in the direction of the longitudinal axis and a first side wall and a second side wall which is arranged opposite the first side wall. A deflection element can be arranged adjacent to the first wall element and the deflection element can have a deflection surface extending in a transverse direction to the wall element at both sides of the wall element, with a first opening being able to be provided in the deflection surface at the side which faces the first side wall of the wall element.

A second and a third wall element can in turn be arranged adjacent to the first opening, with the second and third wall elements extending in the direction of the longitudinal axis and having a respective one inner wall and one outer wall which extend substantially in the direction of the longitudinal axis. Each of the inner walls and outer walls can include an angle between 20° and 160° with the first or second side wall of the first wall element. The first opening can be arranged between the inner walls of the second and third wall elements and a second opening can be arranged outside one of the outer walls of the second or third wall elements, with the second opening being able to be provided in the deflection surface at the side which faces the second side wall of the first wall element.

This means that a second and a third wall element can thus be arranged opposite the first wall element adjacent to the first opening in the direction of the longitudinal axis, with the second and third wall elements being able to bound a passage starting from the first opening and extending in the direction of the longitudinal axis. A second opening can be provided in the deflection surface at the side which faces the second side wall of the wall element, with the second or third wall elements being able to adjoin the second opening, with the second installation body composed of the first wall element, the deflection element and the second and third wall elements being able to be arranged rotated about the longitudinal axis by an angle of 10° up to and including 180° with respect to the first installation body.

The second installation body can in particular have the same structure as the first installation body. The first installation body can be arranged rotated about an angle of 180° with respect to the second installation body.

All the installation bodies of the mixing element can in particular be connected by means of a bar element. The bar element can be arranged at the outer periphery of the deflection element. A bar element can be provided at each side of the wall element, but a plurality of bar elements can also be provided; in particular two respective bar elements can be provided at each side of the wall element.

The wall element can include an angle from 90 to 130° with the deflection surface.

The deflection surface can have a surface curved at least partly in the direction of the flowing fluid for deflecting the fluid flow in a direction differing from the longitudinal axis; a progressive curvature in the flow direction and in the direction of the mixer housing can in particular be provided.

In accordance with an alternative embodiment, the deflection surface can be substantially planar. The deflection surface can in particular substantially extend at an angle of 90° to the wall element.

The deflection surface of the first installation body is in particular designed so that it covers the openings of the second installation body in the direction of the longitudinal axis.

In accordance with a further embodiment, the surface of the deflection element at the side which faces the first side wall of the wall element can lie at least partly in a transverse plane which is aligned at an angle of 60° to 90° to the longitudinal axis. Furthermore, the surface of the deflection element at the side which faces the second side wall of the wall element can lie at least partly in a transverse plane which is aligned at an angle of 60° to 90° to the longitudinal axis.

A reinforcement element can be provided between the second and third wall elements of the first installation body and the first wall element of the second installation body at their connection point. The transition between the first and second installation bodies can be improved in its shape stability and stiffness by this reinforcement element. The flow cross-section for the polymer melt is also increased at a connection point having a reinforcement element. The reinforcement element can be formed, for example, as a thickened portion or as a rib.

The static mixing element can in particular contain a foamed polymer. With respect to the conventional injection molding process in this case, a polymer containing a foaming agent is used for the manufacture of the static mixer which foams during or directly subsequent to the injection. The injection molding method in particular includes the step of the injection of a polymer containing a foaming agent into an injection molding tool at an inner tool pressure of less than 600 bar, particularly preferably less than 500 bar.

A static mixer contains a mixing element in accordance with one of the preceding embodiments and a mixer housing which surrounds the mixing element.

The installation body has a length dimension and a diameter. For non-circular tubular mixer housings, the diameter corresponds to the edge length when the cross-sectional area of the tubular mixer housing is quadratic. For other shapes of the mixer housings, for example with rectangular or oval cross-sections, an equivalent diameter $D_a$ is determined under the assumption that the cross-sectional area were circular, that is using the formula $D_a=2*(A/\pi)^{1/2}$. $D_a$ then stands for the equivalent diameter; A for the actual cross-sectional area. The ratio of longitudinal dimension to diameter is at least 1, with either the diameter of the circular cross-section or the equivalent diameter for non-circular cross-sections having to be used as the diameter.

The length dimension is the extent of the installation body in the direction of the longitudinal axis. The ratio of the length dimension to the diameter can in particular be greater than 1.

A plurality of installation bodies can in particular be arranged behind one another along the longitudinal axis. These installation bodies can either have the same construction or installation bodies of different construction can be combined with one another so that a mixer arrangement arises such as is shown in EP 1 312 409 B1. The adjacent installation bodies are connected to one another at least via the bar elements so that the mixing element which is made up of this plurality of installation bodies is designed as a monolithic part. This means that the mixing element is manufactured in its totality in a single injection molding tool.

The installation body or the totality of the installation bodies can have a longitudinal dimension between 5 and 500 mm, preferably between 5 and 300 mm, preferentially between 50 and 100 mm.

The static mixer contains a mixing element in accordance with one of the preceding embodiments and a mixer housing which surrounds the mixing element. The mixing element has a longitudinal axis which coincides with the longitudinal axis of the mixer housing in the assembled state. Each of the installation bodies therefore also has this longitudinal axis. The longitudinal axis is aligned in the direction of a fluid flowing into the static mixer. The fluid includes at least two components which are supplied via an inlet element arranged upstream of the mixing element.

The flow of the fluid to be mixed is deflected in the interior of the mixing space by means of the deflection element so that the components which enter into the tubular mixer housing with an installed mixing element as strands are divided continuously during their path through the static mixer into strips of reducing width, whereby components which are difficult to mix or have high viscosity can also be processed with this static mixer.

The fluid to be mixed as a rule includes two different components. In most cases, the components are present in the fluid state or as viscous materials. These include, for example, pastes, adhesives, but also fluids which are used in the medical sector which include pharmaceutical agents or fluids for cosmetic applications and foods. Such static mixers are also in particular used as disposable mixers for the mixing of a hardening mixing product of flowable components such as the mixing of multicomponent adhesives or sealing materials. Another preferred use is in the mixture of impression materials in the dental field.

The components can be mixable in a ratio of 2:1 up to an including 20:1, in particular 4:1 up to and including 10:1.

The static mixers described above are suitable as disposable mixers since their manufacturing and material costs are low as soon as the corresponding injection molding tool has been manufactured. Furthermore, the static mixers are used in metering and/or mixing units. The static mixer can be attached to a dispensing unit or to a dispensing cartridge, in particular to a multicomponent cartridge. In particular a multicomponent cartridge can be named as an example which includes a dispensing apparatus and a pipe which is coupled to the dispensing apparatus and which contains a static mixer in accordance with one of the preceding embodiments. The multicomponent cartridge in particular contains two cartridge outlets for the taking up and fluid-tight connection of the respective cartridge outlet with the entry openings of a static mixing element in accordance with one of the previous embodiments as well as a holder for the captive reception of the mixer housing.

Additional features and advantages are described herein, and will be apparent from the following Detailed Description and the figures.

BRIEF DESCRIPTION OF THE FIGURES

The invention will be explained in the following with reference to the drawings. There are shown.

DETAILED DESCRIPTION

Figure 1:
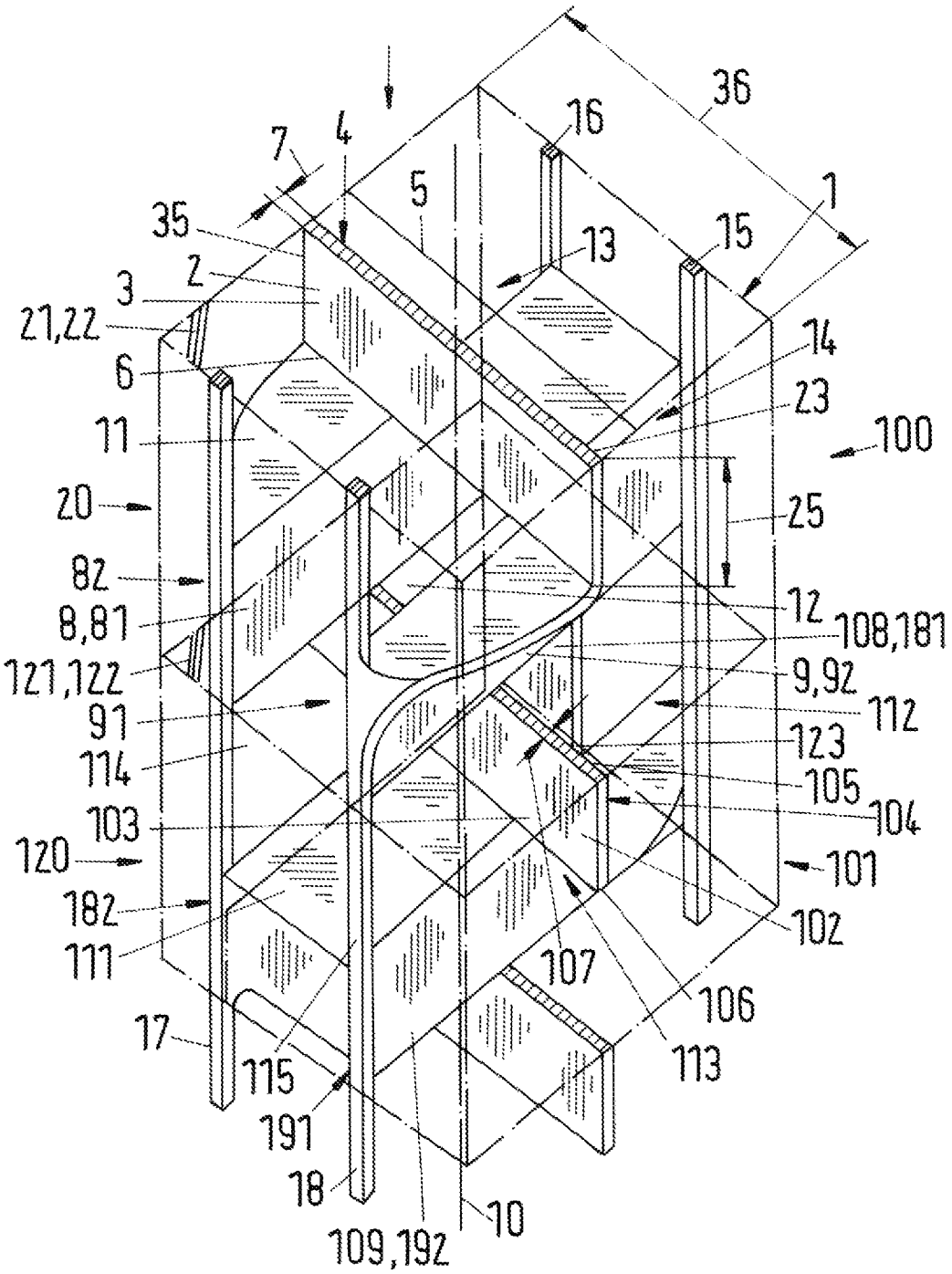
FIG. 1 an embodiment of a section of a mixing element in accordance with a first embodiment of the invention.

An embodiment of a mixing element 100 for a static mixer in accordance with a first embodiment of the invention is shown in FIG. 1. The mixing element includes an installation body 1 which is installed in a tubular housing which is not shown. The tubular housing serves as a boundary of a mixing space 20 which is located in the interior of the tubular housing. A fluid to be mixed, which is as a rule made up of at least two different components, flows through the mixing space 20. In most cases, the components are present in the fluid state or as flowable, in particular viscous materials. These include, for example, pastes, adhesives, but also fluids which are used in the medical sector which include pharmaceutical agents or fluids for cosmetic applications and foods. Such static mixers are also in particular used as disposable mixers for the mixing of a hardening mixing product of flowable components such as the mixing of multicomponent adhesives. Another preferred use is in the mixing of impression materials in the dental field.V The mixing element in accordance with FIG. 1 thus includes an installation body 1 for installation into a tubular mixer housing, with the installation body 1, 101 having a longitudinal axis 10 which is aligned in the direction of a fluid flowing into the installation body 1. A mixing space 20 which is bounded at the peripheral side by a mixer housing, not shown, can be spanned by the installation body 1. A cubic mixing space is indicated in FIG. 1 to facilitate understanding. The side surfaces of the cube can represent the inner walls of the mixer housing. The fluid flows from the cover surface of the cube, which forms a flow cross-sectional area 22, in the direction of the installation body 101.

The installation body 1 and the installation body 101 have the same structure; however, the installation body 101 is rotated by 180° about the longitudinal axis 10. Like the mixing space 20, the mixing space 120 has a flow cross-sectional area 122 in a plane 121 arranged normal to the longitudinal axis 10 which essentially corresponds to the flow cross-sectional area of the tubular mixer housing surrounding the installation body 101. For installation bodies 1, 101 which have at least one plane of symmetry which divides the mixing space into two equal parts, the longitudinal axis is disposed in this plane of symmetry. The mixing space is bounded at the peripheral side by the mixer housing, not shown. In this embodiment, the mixing element should be installed into a mixer housing having a rectangular or quadratic cross-section. The inner dimension of the mixer housing which is used for determining the equivalent diameter is given by reference line 36.

The installation body 1 contains at least one first wall element 2 which serves a division of the fluid flow into two part flows flowing substantially parallel to the longitudinal axis 10. The wall element 2 has a first side wall 3 and a second side wall 4. The intersection of the first wall element 2 with the plane 21 produces a cross-sectional area 23. This cross-sectional area 23 amounts to a maximum of ⅕, preferably a maximum of 1/10, particularly preferably a maximum of 1/20 of the flow cross-sectional area 22 of the mixing space 20 without installation bodies. The fluid thus flows at both sides of the side walls 3, 4 of the wall element 2. The flow direction of the fluid is indicated by an arrow. The wall element has a substantially rectangular cross-section. The first wall element 2 has a first wide side 5, a second wide side 6 as well as a first and second long side 25, 35. The first wide side 5, the second wide side 6, the first long side 25 and the second long side 35 form the periphery of each of the side walls 3, 4. The long sides 25, 36 extend substantially in the direction of the longitudinal axis 10 and the first wide side 5 and the second wide side 6 extend transversely to the direction of the longitudinal axis. The first wall element 2 divides the mixing space into two parts. The wall element 2 has the function of a bar element which divides the fluid flow into two parts, with their deflection being negligible with the exception of the deflection at the edges of the first wide side 5. The wall thickness 7 of the wall element 2 usually amounts to less than 1 mm for a mixing element with a total length of up to 100 mm.

A deflection element 11 which serves for the deflection of the part flows in a direction differing from the longitudinal axis adjoins the first wall element 2. The deflection element has a deflection surface extending in the transverse direction to the wall element 2 at both sides of the wall element. A first opening 12 is provided in the deflection surface at the side which faces the first side wall 3 of the wall element 2.

The crossing angle between the first wall element 2 and the second or third wall element 8, 9 respectively amounts to 90° in the embodiment in accordance with FIG. 1. In accordance with FIG. 1, the first wall element 2 is connected to the second wall element 8 and to the third wall element 9 via the deflection element 11. The deflection element 11 is preferably disposed in a plane which is aligned parallel to the plane 21 or is arranged at an angle of inclination with respect to the plane, with the angle of inclination amounting to no more than 60°, preferably no more than 45°, particularly preferably no more than 30°. The smaller the angle of inclination between the surface of the deflection element 11 and the plane 21, the smaller the required construction length. Or in other words: the surface of the deflection element 11 is substantially disposed in a transverse plane which is aligned at an angle from 45° up to 90°, preferably from 60° up to 90°, particularly preferably from 75° up to 90° to the longitudinal axis 10.

The wall elements 8, 9 adjoining the deflection element 11 bound a passage which starts from the first opening 12 and extends in the direction of the longitudinal axis 10. It is meant by the expression "adjoining the deflection element" that the second and third wall elements 8, 9 are arranged opposite the first wall element 2 in the direction of the longitudinal axis, that is are arranged downstream of the first wall element 2 in the direction of flow.

A second opening is provided in the deflection surface at the side which faces the second side wall 4 of the wall element 2, with the second or third wall elements 8, 9 adjoining the second opening. The second and third wall elements 8, 9 bound the same passage which also starts from the first opening 12.

A second and a third wall element 8, 9 are thus arranged adjacent to the first opening 12. The second and third wall elements 8, 9 extend in the direction of the longitudinal axis 10 and each have an inner wall 81, 91 and an outer wall 82, 92 which extend substantially in the direction of the longitudinal axis 10. The second wall element 9 has the inner wall 81 and the outer wall 82. The third wall element 91 has the inner wall 91 and the outer wall 92. In the present embodiment, the inner walls 81, 91 and the outer walls 82, 92 extend in the direction of the longitudinal axis, that is in the vertical direction in the direction of the drawing. Each of the inner walls 81, 91 and outer walls 82, 92 can include an angle between 20° and 160° with the first or second side walls 3, 4 of the first wall element 2. The first opening 12 is arranged between the inner walls 81, 91 of the second and third wall elements 8, 9. A second opening 13 and an optional third opening 14 are arranged outside one of the outer walls 82, 92 of the second or third wall elements 8, 9. The second opening 13 and the third opening 14 are provided in the deflection surface at the side which faces the second side wall 4 of the first wall element 2. The inner wall of each wall element can in particular be parallel to its outer wall. Furthermore, the second and third wall elements can have inner walls 81, 91 and outer walls 82, 92 respectively in parallel with one another.

The first wall element 102 of the second installation body 101 adjoins the second and third wall elements 8, 9. The second installation body 101 has a first wall element 102 which extends in the direction of the longitudinal axis 10 of the mixing element and has a first side wall 103 and a second side wall 104 which is arranged opposite the first side wall 103. The first side wall 103 and the second side wall 104 are arranged substantially parallel to the longitudinal axis 10.

A deflection element 111 is arranged adjacent to the first wall element 102. The deflection element 111 has a deflection surface extending in the transverse direction to the wall element 102 at both sides thereof. A first opening 112 is provided in the deflection surface at the side which faces the second side wall 104 of the wall element 102. A second and a third wall element 108, 109 are arranged opposite the first wall element 102 in the direction of the longitudinal axis 10 adjacent to the first opening 112.

That is, the second and third wall elements 108, 109 are located downstream of the first wall element 102. The second and third wall elements 108, 109 bound a passage starting from the first opening 112 and extending in the direction of the longitudinal axis 10. A second opening 113, 114 is provided in the deflection surface at the side which faces the first side wall 103 of the wall element 102. The second or third wall elements 108, 109 adjoin the second opening 113, 114.

A second wall element 108 and a third wall element 109 are arranged adjacent to the first opening 112. The second and third wall elements 108, 109 extend in the direction of the longitudinal axis 10 of the mixing element. The second wall element has an inner wall 181 and an outer wall 182 and the third wall element has an inner wall 191 and an outer wall 192. The outer walls 182, 192 and the inner walls 181, 191 extend substantially in the direction of the longitudinal axis 10 of the mixing element. They are respectively parallel to one another in the present embodiment. Each of the inner walls 181, 191 and outer walls 182, 192 include an angle between 20° and 160° with the first or second side walls 103, 104 of the first wall element 102; 90° in the present case. The first opening 112 is arranged between the inner walls 181, 191 of the second and third wall elements 108, 109 and at least one second opening 113, 114 is arranged outside one of the outer walls 182, 192 of the second or third wall elements 108, 109. The second opening 113 and/or a third opening 114 are provided in the deflection surface at the side which faces the second side wall 104 of the first wall element 102.

The second installation body 101 containing the first wall element 102, the deflection element 111 and the second and third wall elements 108, 109 is arranged rotated about the longitudinal axis 10 by an angle of 10° up to and including 180°, in the specific example of 180°, with respect to the first installation body 1.

The first installation body 1 and the second installation body 101 have the same structure, that is they contain the same wall elements and the same deflection elements which are arranged at respectively the same angles and spacings from one another.

The first installation body 1 and the second installation body 101 are connected to one another via a plurality of common bar elements 15, 16, 17, 18.

Figure 2:
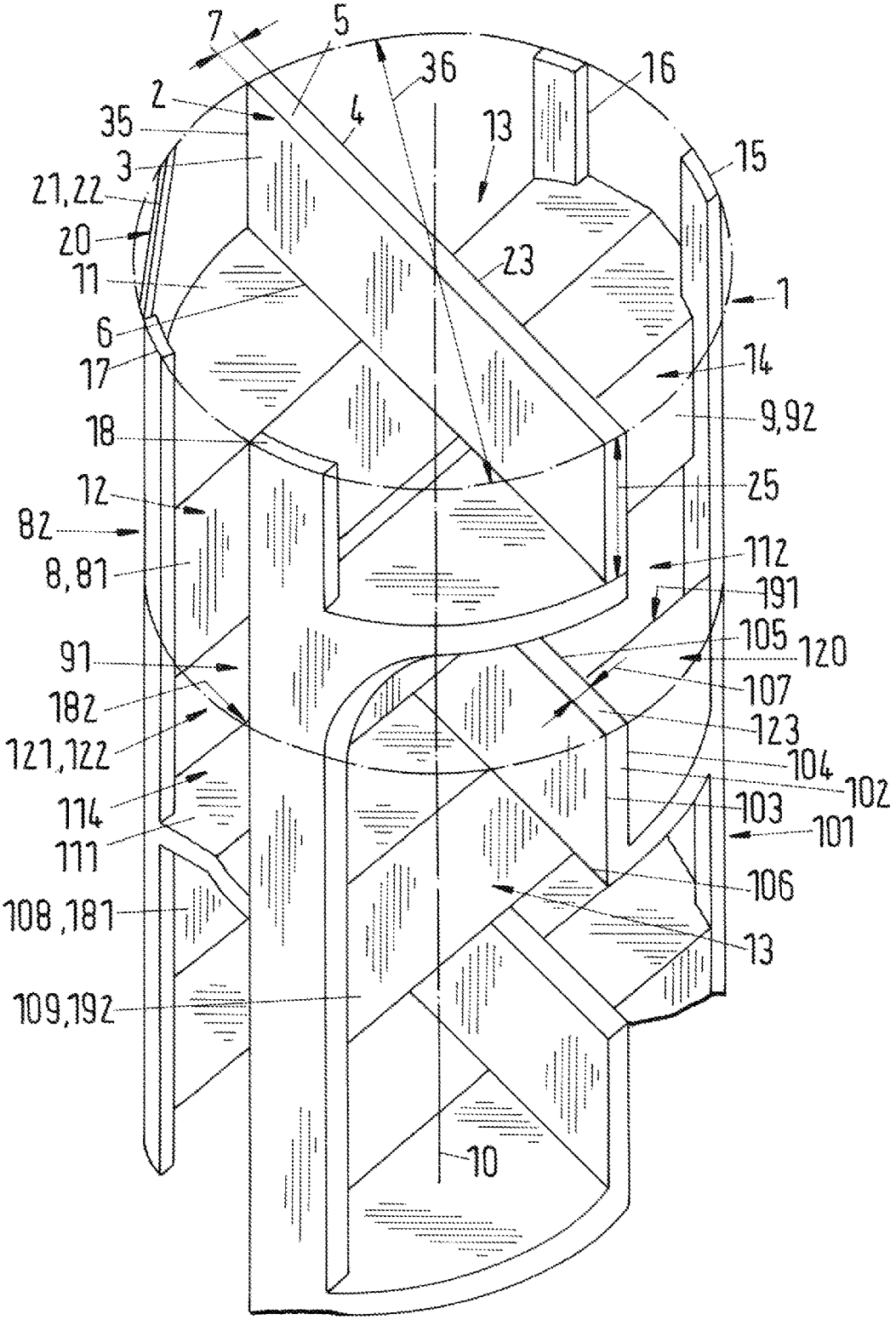
FIG. 2 an embodiment of a section of a mixing element in accordance with a second embodiment of the invention.
Figure 3C:
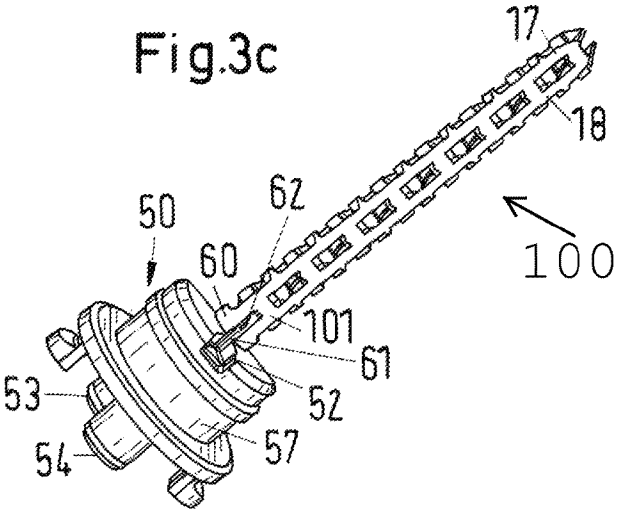
FIGS. 3*a*-3*d* views of a mixing element with installation bodies in accordance with FIG. 2.
Figure 3D:
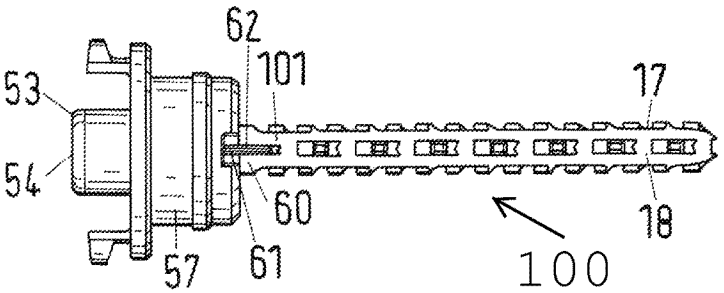
Figure 3A:
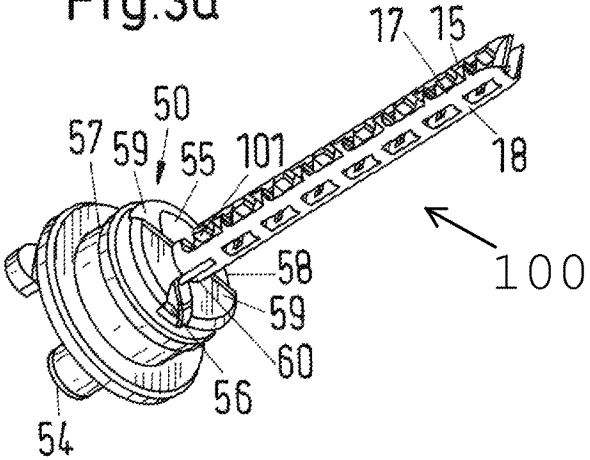
Figure 3B:
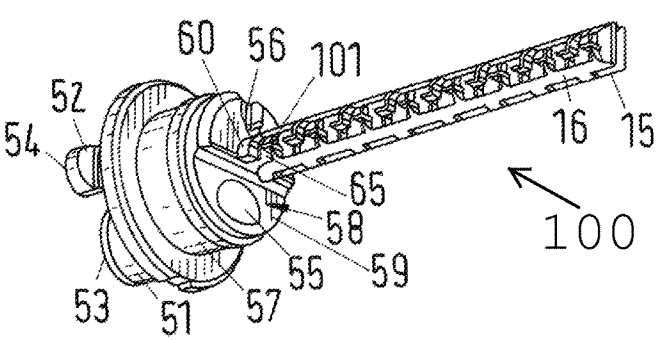

FIG. 2 shows an embodiment of a section of a mixing element in accordance with a second embodiment of the invention. The structure of the mixing element does not substantially differ from the mixing element in accordance with FIG. 1; the same reference numerals as in FIG. 1 are therefore used for the same parts. Only the differences from the embodiment in accordance with FIG. 1 should be looked at in the following. A first installation body 1 and a second installation body 101 of the mixing element are shown in turn. The installation bodies are intended for installation into a mixer housing having a circular or elliptical cross-section. The cross-sectional extent of the inner wall of the mixer housing, not shown, is indicated by a chain-dotted line. The diameter of the mixer housing is shown by a reference line 36.

FIG. 3*a* to FIG. 3*d* each show a view of a first embodiment of a mixing element in accordance with the invention. The mixing element 100 contains installation bodies, as shown in FIG. 2. All installation bodies are connected to one another by bar elements 15, 16, 17, 18. Furthermore, the mixing element 100 contains an inlet element 50 which contains the inlet passages 51, 52 for the components to be mixed. The mixing ratio of the two components can be equal to 1:1, but can also be different, that is not equal to 1:1. The components can be mixable in a ratio of 2:1 up to and including 20:1, in particular 4:1 up to and including 10:1.

The inlet element 50 is arranged upstream of the first installation body 1. The inlet element 50 and the installation body 1 are connected to one another via a connection element 60. The inlet element 50 has a body 57 which can be sealingly taken up at the peripheral side in the mixer housing. The body 57 has a first inlet passage 51 and a second inlet passage 52. Each of the inlet passages 51, 52 has an entry opening 53, 54 and an exit opening 55, 56 so that the corresponding component can be conducted through the corresponding inlet passage 51, 52 from the entry opening 53, 54 to the exit opening 55, 56. The first inlet passage 51 extends spatially separately from the second inlet passage 52. The first inlet passage 51 opens into a pre-chamber 58. The pre-chamber 58 is bounded by the outlet side 59 of the body 57, by the connection element 60, by the inner wall of the mixer housing as well as by the first installation body. The second inlet passage 52 extends from the exit opening 56 into an inner space 61 of the connection element 60. A continuation passage 62 opens into a mixing space 65 of the first installation body 1 from the inner space 61 of the connection element 60.

Figure 4:
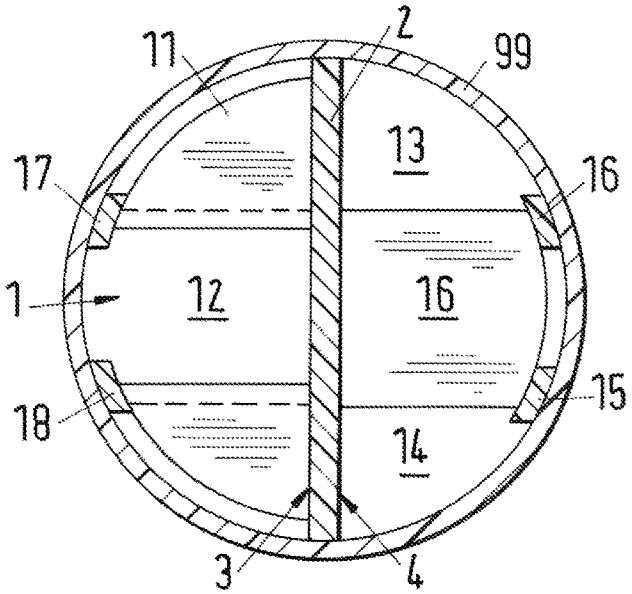
FIG. 4 a section through an installation body in accordance with FIG. 2.

FIG. 4 shows a section through the installation body 1 of FIG. 2. The first wall element 2 and the bar elements 15, 16, 17, 18 are in sections. The deflection element 11 is visible in the section in accordance with FIG. 4. The deflection element 11 contains the first opening 12 which is arranged at the left side of the first wall element 2 in FIG. 4, that is on the side of its first side wall 3. The second opening 13 and the third opening 14 are arranged on the opposite side, that is on the second side wall 4. The first opening 12 is arranged offset with respect to the second and third openings 13, 14. A part element 26 of the deflection element is arranged between the second and third openings. The fluid which impacts onto the part element 26 is deflected in the direction of the second opening 13 and of the third opening 14. At the peripheral side, the second opening 13 and the third opening 14 are bounded by the mixer housing 99.

Figure 5:
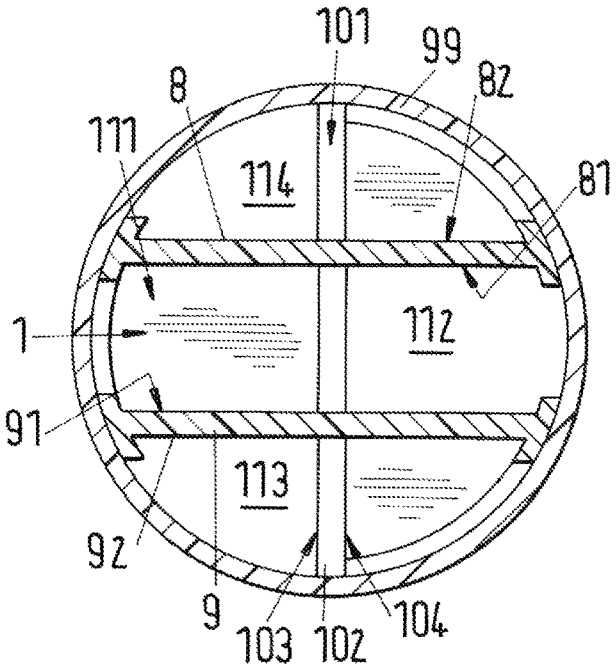
FIG. 5 a section through an installation body which is arranged adjacent to the installation body in accordance with FIG. 4.

FIG. 5 shows a section through the second and third wall elements 8, 9 of the installation body 1. The direction of gaze is in the direction of flow so that the first wall element 102 of the installation body 101 is visible. The deflection element 111 adjoins the first wall element 102 of the installation body 101. The deflection element 111 contains a first opening 112 which is arranged on the side of the second side wall 104. A second opening 113 and a third opening 114 are arranged on the side of the first side wall 103. The second opening 113 and the third opening 114 are arranged offset to the first opening 112. The first, second and third openings 112, 113, 114 are arranged such that a part element is respectively arranged opposite each of the openings, that is a first part element opposite the first opening 112, a second part element 127 opposite the second opening 113 and a third part element 128 opposite the third opening.

Figure 6B:
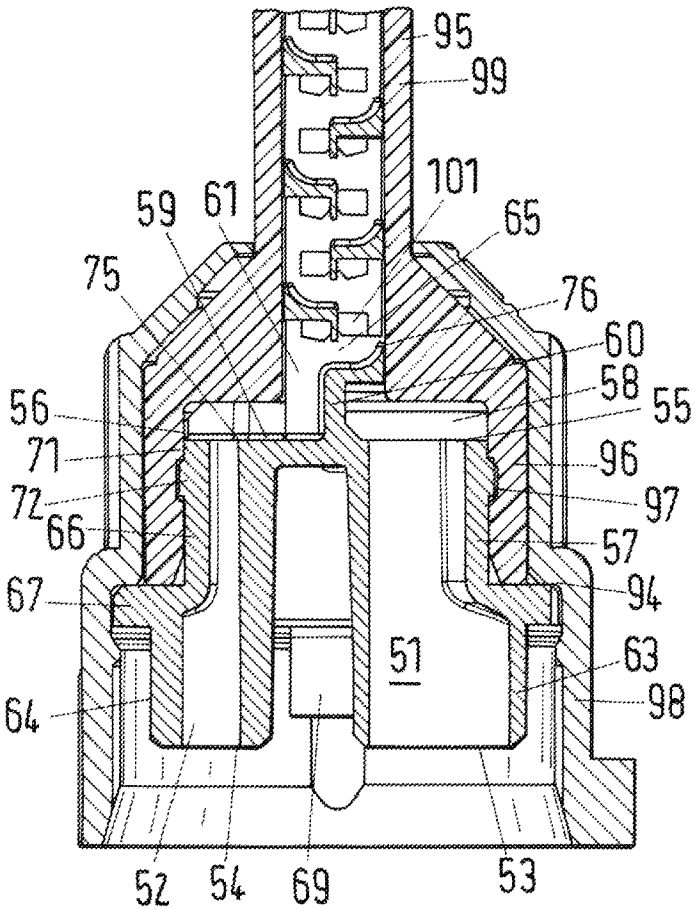
FIGS. 6*a*, 6*b* sections through an inlet part of a static mixer and mixing element in accordance with FIG. 3.
Figure 6A:
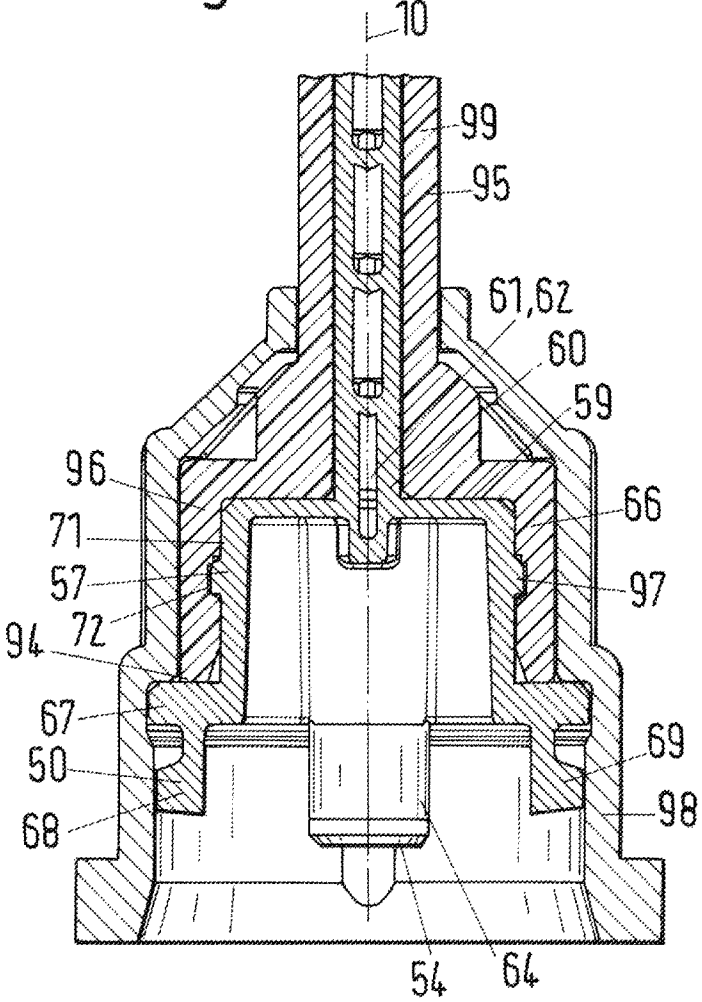

FIG. 6*a* and FIG. 6*b* show a section through an inlet element 50 of a static mixer and a mixing element 100 in accordance with FIG. 3*a* to FIG. 3*d*. The static mixer includes a mixer housing 99 in which the mixing element 100 and the inlet element 50 are received. The mixer housing 99 is received in a holding element 98 which serves for the connection to a cartridge not shown here. FIG. 6*a* shows a longitudinal section through the static mixer which is placed along its longitudinal axis 10. The section is placed such that the stub 63 which contains the inlet passage 51 is not visible because this stub 63 comes to lie in front of the plane of the drawing. The stub 64 which contains the inlet passage 52 is visible.

The cap element 66 which is part of the body 57 of the inlet element is held in the mixer housing. The inlet passages 51, 52 extend through the cap element 66, which is visible in FIG. 6*b*. The cap element 66 can have a peripheral projection 72 which extends along the jacket 71 of the cap element 66. The projection 72 is received in a corresponding cut-out 97 of the mixer housing 99. The cap element 66 can be captively held in the mixer housing 99. A rotation of the cap element 66 relative to the mixer housing 99 is, however, possible to ensure that the mixing element 50 can be placed correctly onto the outlets of the cartridge. For this purpose, the stubs 63, 64 are placed onto the corresponding outlets or are inserted into the corresponding outlets so that the stubs 63, 64 surround the outlets or the outlets 63, 64 enclose the stubs 63, 64.

A flange element 67 serves as a support for the mixer housing 99. The mixer housing 99 is made in two stages. The inlet part 96 of the mixer housing 99 has a larger inner diameter than the main part 95 of the mixer housing. The main part 95 of the mixer housing 99 contains the installation bodies of the mixing element, the inlet part 96 contains the cap element 66 of the body 57 of the inlet element 50. The flange element is also received in a holding element 98. The flange element 67 also forms the support of the end of the inlet part 96 of the mixing element. The holding element 98 serves to fasten the static mixer to the cartridge. The holding element 98 is usually provided with bayonet fastening means for this purpose.

The inlet passage 51 extends within the stub 63 and continues through the flange element 67 into the cap element 66. The inlet passage 51 thus starts at the entry opening 53 and ends at the exit opening 55. The inlet passage 52 extends within the stub 64 and continues through the flange element 67 into the cap element 66. The inlet passage 52 thus starts at the entry opening 54 and ends at the exit opening 56. A continuation passage 62 leads from the inlet passage 52 into the inner space 61 of the connection element 60. The connection element 60 can in particular be formed as the first wall element of the first installation body 1. The second inlet passage 52 can in particular be constricted in the inner space 61 of the connection element 60. The second inlet passage 52 extends in the inner space 61 of the connection element 60 from an entry side 75 to an exit side 76. The inlet passage 52 has an inner diameter which reduces continuously from the entry side 75 up to the exit side 76.

A guide element can be provided in the pre-chamber between the first exit opening 55 and the connection element 60. This guide element is not shown in the drawing. The guide element can be made, for example, as a dam element. The component exiting from this exit opening 55 is deflected and divided along this dam element. This dam element can be formed in beam shape. An example for such a dam element can be found in EP 0 885 651 A1, called a dividing edge there. The guide element can in particular at least partly cover the first exit opening 55.

The first inlet passage 51 of the inlet passage 50 has a cross-sectional area at the exit opening 55 which differs from the cross-sectional area of the second inlet passage 52 at the exit opening 56. Such an inlet element 50 is used for components which can be mixed in the a ratio from 2:1 up to and including 20:1, in particular 4:1 up to and including 10:1.

Figure 7A:
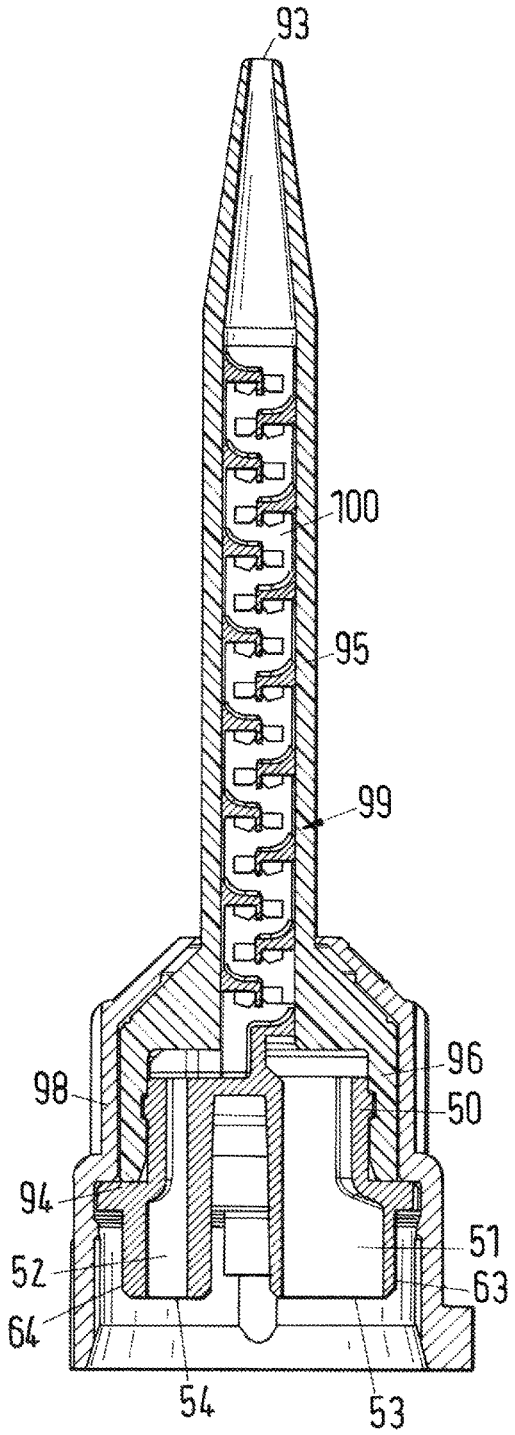
FIGS. 7*a*, 7*b* sections through the mixer housing, the mixing element as well as the holding element of a static mixer in accordance with one of the preceding Figs. in the assembled state.
Figure 7B:
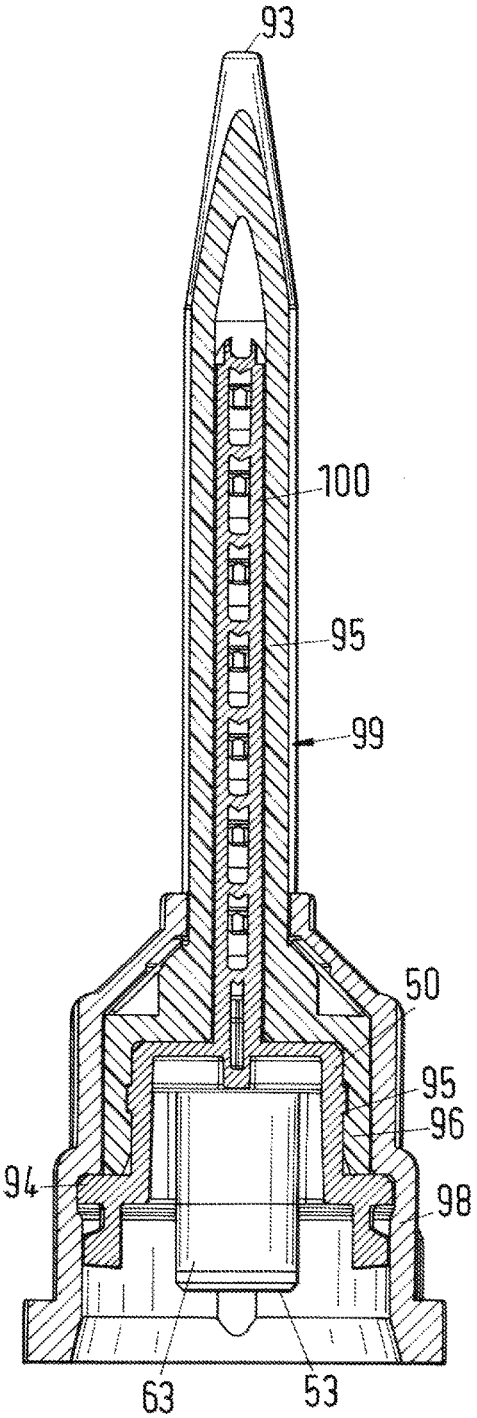

FIG. 7*a* and FIG. 7*b* each show a section through a complete mixing element 100 which is received in the mixer housing 99. The mixer housing 99 is made up of an inlet part 96 and a main part 95. The inlet part 96 contains the inlet element 50 of the mixing element 100. The main part 95 contains the installation bodies 1, 101 of the mixing element 100. The mixer housing has an inlet end 94 and an outlet end 93. Two or more components enter into the mixer housing separately from one another via the inlet element and are brought into contact with one another in the first installation body 1. The wall elements of the installation body serve for the division of the component flow and the deflection elements serve for the deflection of the component flow, that is for the bringing about of a local destratification of the component flow. The components are mixed by the division and deflection of the component flow continuing over the length of the mixing element. A homogeneous filler material exits at the outlet end 93 of the mixer housing 99.

The bar elements 15, 16, 17, 18 hold all installation bodies of the mixing element 100 connected to one another. Each of the bar elements increases the bending stiffness of the static mixer. It can furthermore be prevented by the bar elements that a break of the mixing element occurs in the operation of the mixer, in particular when at least two mixing elements are arranged on opposite sides of the first wall elements. Furthermore, it is ensured via the bar element during the manufacture of the installation body in the injection molding process that the polymer melt can flow from the first installation body 1 to the first and all further installation bodies 101 arranged downstream. Without the bar elements, the transition from the wall element 8 or 9 to the wall element 102 disposed downstream would namely only be composed of the common sectional surface and any reinforcement thereof. That is the sectional surface in this case is composed of two squares which would have a side length corresponding to the wall thickness 7. The total polymer melt for the installation bodies disposed downstream would have to pass through these restriction points, which would result in local pressure peaks in the tool. In addition, a long dwell time of the polymer melt would result in the regions of the wall elements which would come to lie close to the tubular housing in use, which would result in variations in the polymer melt and under certain circumstances in a deterioration of the physical properties and in inhomogeneity so that such a mixing element can only be manufactured in the prior art by the use of a melt containing a foaming agent for generating a foamed structure.

For this reason, in accordance with a preferred embodiment, the bar elements for forwarding the polymer melt in the manufacturing process are provided from one installation body to each of the adjacent installation bodies.

The static mixer is usually produced from plastic by means of which even comparatively complicated geometries can be realized in the injection molding process. The totality of installation bodies 1, 101 has a length dimension 24 and each of the cross-sectional areas 23, 123 have a wall thickness 7 in particular for static mixers including a plurality of installation bodies 1, 101. The ratio of length dimension 24 to wall thickness 7 amounts to at least 40, preferably at least 50, particularly preferably at least 75. For the preferred use of static mixers for small quantities of filler material, the wall thickness 7 is less than 3 mm, preferably less than 2 mm, particularly preferably less than 1.5 mm. The totality of the installation bodies 1, 101 has a longitudinal dimension 24 between 5 and 500 mm, preferably between 5 and 300 mm, preferentially between 50 and 100 mm.

Figure 8:
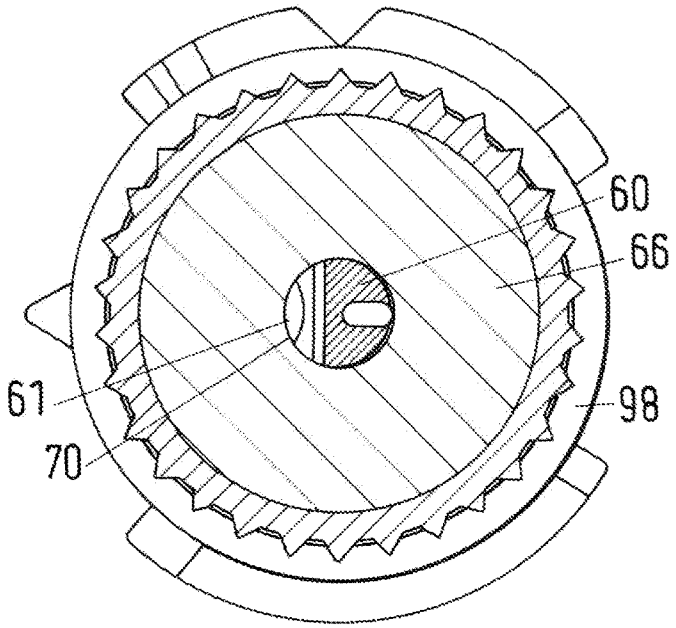
FIG. 8 a section through the mixing element at the level of the continuation passage.

FIG. 8 shows a section through the mixing element at the level of the continuation passage. The section contains the holding element 98 in a partly sectional form with the coding elements and the parts of a bayonet closure by means of which the holding element 98 can be connected to a multi-component cartridge. The cap element 66 which is part of the mixer housing 99 is arranged within the holding element 98. The cap element 66 has a centrally arranged circular opening 70 in which the connection element 60 is received. The connection element 60 does not completely fill the opening, but rather has two cut-outs which form the inner space of the connection element 61. These cut-outs are shown in detail in FIG. 10. The cut-outs are the fluid-conducting passages through which the components to be mixed are supplied to the installation bodies of the mixing element.

Figure 9:
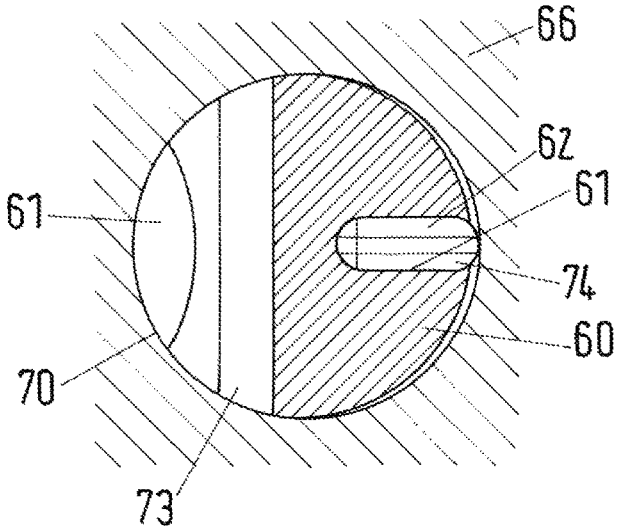
FIG. 9 a detail of FIG. 8.

FIG. 9 shows a detail of FIG. 8, namely the opening 70 in the cap element 66. The connection element 60 which contains two cut-outs 73, 74 which form the inner space of the connection element 61 is located in the opening 70. The cut-out 73 is provided for the component having the larger volume flow; the cut-out 74 serves as a passage for the component having the smaller volume flow. So the cut-out 74 represents a section through the continuation passage 62. In accordance with a preferred embodiment, the ratio of the cross-sectional area of the cut-out 73 to the cut-out 74 is between 4:1 and 5:1. The cross-sectional area of the cut-out 73 in particular amounts to 2.8 $mm^2$ and the cross-sectional area of the cut-out 74 amounts to 0.6 $mm^2$.

Figure 10:
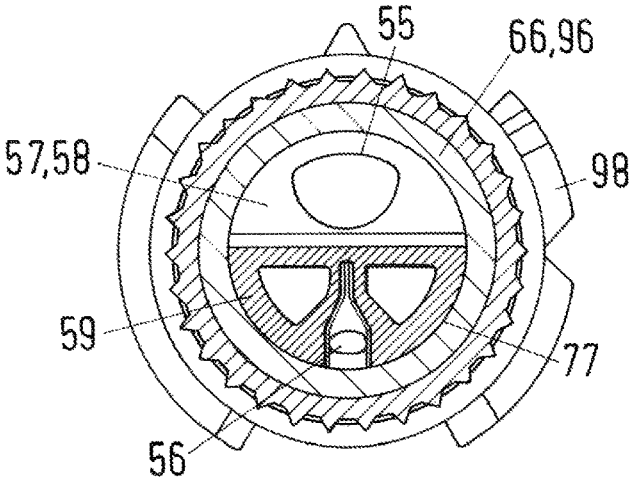
FIG. 10 a section through the mixing element along the outlet side of the body.

FIG. 10 shows a section through the mixing element along the outlet side of the body 57 which contains the inlet passages 51, 52 (see FIG. 6*b*). The exit opening 55 of the inlet passage 51 opens into the pre-chamber 58 which extends between the connection element 60 and the outlet side 59 of the body 57. The exit opening 56 of the inlet passage 52 is separated from the pre-chamber 58 by wall elements 77 forming the outlet side 59 so that the two components do not yet come into contact in the pre-chamber. The wall elements 77 which bound the connection passage 78 leading to the connection element 60 are shown in detail in FIG. 11. The ratio of the cross-sectional areas of the pre-chamber 58 to the connection passage 78 as shown in the present section amounts to at least 5:1, with the component having the larger volume flow being contained in the pre-chamber 58. In accordance with an embodiment, the cross-sectional area of the pre-chamber can in particular amount to 32.4 $mm^2$; the cross-sectional area of the connection passage 78 6.2 $mm^2$. The cross-sectional area of the entry opening 53 belonging to the exit opening 55 and shown in FIG. 6*b* then amounts to 15.9 $mm^2$. The cross-sectional area of the entry opening 54 belonging to the exit opening 56 and shown in FIG. 6*b* then amounts to 2.8 $mm^2$. For this embodiment, the volume of the two components in the inlet region, that is from the corresponding entry opening 53, 54 up to the entry into the first installation body of the mixing element, for the component having the larger volume flow amounts to 171 $mm^3$ and for the component having the smaller volume flow 28 $mm^3$. This corresponds to a ratio of approximately 6:1.

Figure 11:
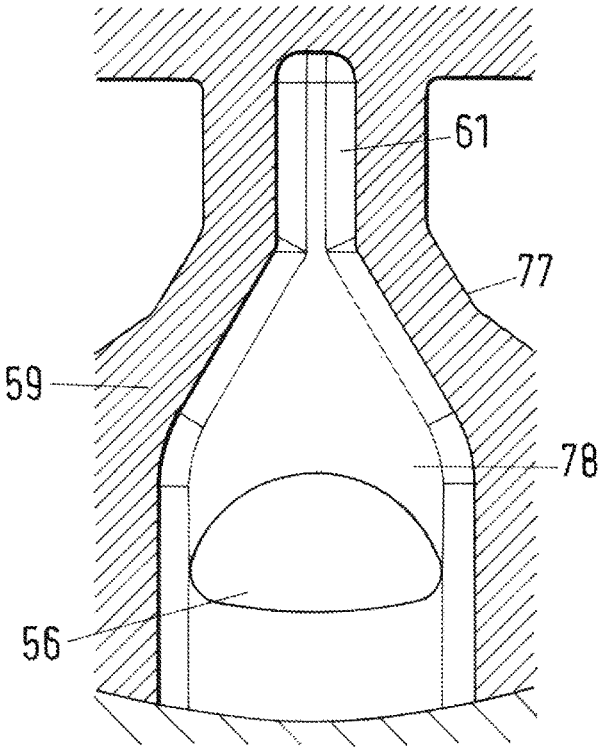
FIG. 11 a detail of FIG. 9.

FIG. 11 shows a detail of FIG. 10, namely the wall elements 77 which bound the connection passage 78 leading to the connection element 60. FIG. 11 in particular shows that the connection passage 78 constricts from the exit opening 56 up to the entry into the inner space of the connection element 61. This constriction can in particular take place by at least sectionally conical passage walls.

The ratio of the cross-sectional area of the continuation passage 62 and of the remaining free cross-sectional area in a sectional plane which is laid normal to the longitudinal axis and is arranged at the mixer inlet amounts to at most 1:4. The cross-sectional area of the continuation passage 62 is the area of the cut-out 74 of FIG. 9. The "remaining free cross-sectional area" refers to the area shown by the cut-out 73. The mixing ratio of the components can amount to 4:1, but also to at least 5:1 in accordance with an alternative embodiment; it can also amount to at least 10:1 or even above this. A mixing element having the same dimensions is preferably used for all mixing ratios of the components. The following additional geometrical conditions thus apply in an analog manner to cross-sectional ratios from 5:1 to 10:1 or more.

The mixer housing in accordance with an embodiment has a step on which the outlet side of the body lies. The sectional plane can in particular be arranged between this step and the first installation body.

Directly adjoining the exit opening, the cross-sectional area ratio of the cross-sectional areas available for the components at this point can amount to at least 5:1. The ratio of the cross-sectional areas of the entry openings is at least 5:1.

The cross-sectional area of the inlet opening to the cross-sectional area adjoining the outlet opening increases by at least double for at least one of the components. The cross-sectional area from the inlet opening to the cross-sectional area adjoining the outlet opening in particular increases by at least double for each of the components.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A mixing element for a static mixer and configured to be installed into a tubular mixer housing, the mixing element comprising:

at least one first installation body and one second installation body arranged behind one another along a longitudinal axis of the mixing element; and an inlet element arranged upstream of the first installation body, the inlet element and the first installation body being integrally connected via a connection element, the inlet element having a body configured to be sealingly taken up peripherally in a tubular mixer housing, the body of the inlet element having a first inlet passage and a second inlet passage, the first inlet passage having a first entry opening and a first exit opening, the first entry opening being disposed in a first outer surface of the body of the inlet element that extends transverse to the longitudinal axis of the mixing element, the first exit opening being disposed in a second outer surface of the body of the inlet element opposite the first outer surface and that extends transverse to the longitudinal axis of the mixing element, the first inlet passage extending through the body of the inlet element from the first entry opening to the first exit opening, the second inlet passage having a second entry opening and a second exit opening so that corresponding components can be conducted through the first inlet passage from the first entry opening to the first exit opening and through the second inlet passage from the second entry opening to the second exit opening, the first inlet passage extending spatially separately from the second inlet passage, the first inlet passage configured to open into a pre-chamber external to the body of the inlet element and that is defined by the second outer surface of the body of the inlet element, by the connection element, by an inner wall of the mixer housing and by the first installation body, the first inlet passage being upstream of the second outer surface of the body and configured to be disposed at least partially within the mixer housing, the second inlet passage extending from the second exit opening into an inner space of the connection element such that a continuation passage opens into a mixing space of the first installation body from the inner space of the connection element, the pre-chamber and the inner space being separated by the connection element such that components in the pre-chamber are separated from components in the inner space, the inlet element includes a wall element separating the first exit opening from the second exit opening to maintain separation of the components in the pre-chamber and the inner space of the connection element, a ratio of a cross-sectional area of the continuation passage to a remaining free cross-sectional area being at most 1:4, the cross-sectional areas being taken on a sectional plane normal to the longitudinal axis and arranged at a mixer entry.

2. The mixing element in accordance with claim 1, wherein the second inlet passage constricts in the inner space of the connection element.

3. The mixing element in accordance with claim 1, wherein the second inlet passage extends in the inner space of the connection element from an entry side to an exit side, the second inlet passage having an inner diameter reducing continuously from the entry side up to the exit side.

4. The mixing element in accordance with claim 1, wherein a ratio of a cross-sectional area directly following one of the first and second exit openings and available for the components at this point to a cross-sectional area directly following the other of the first and second exit openings and available for the components at this point is at least 5:1.

5. The mixing element in accordance with claim 1, wherein a ratio of a cross-sectional area of one of the first and second entry openings to a cross-sectional area of the other of the first and second entry openings is at least 5:1.

6. The mixing element in accordance with claim 1, wherein a ratio of a cross-sectional area of one of the first and second entry openings to a cross-sectional area adjoining the corresponding first or second exit opening is at least 2:1.

7. The mixing element in accordance with claim 1, wherein the first installation body has a first wall element which extends in the direction of the longitudinal axis and has a first side wall and a second side wall which is arranged opposite the first side wall, the first wall element forming the connection element.

8. The mixing element in accordance with claim 7, further comprising a deflection element arranged adjacent to the first wall element of the first installation body and the deflection element has a deflection surface extending in a transverse direction to the first wall element of the first installation body at both sides of the first wall element of the second installation body, a first opening being provided in the deflection surface at the side which faces the first side wall of the first wall element of the first installation body, a second and a third wall element arranged adjacent to the first opening, the second and third wall elements extending in the direction of the longitudinal axis, each have an inner wall and an outer wall, which extend substantially in the direction of the longitudinal axis and each of the inner walls and outer walls include an angle between 20° and 160° with the first or second side wall of the first wall element of the first installation body, the first opening being arranged between the inner walls of the second and third wall elements, a second opening being arranged outside one of the outer walls of the second or third wall element, the second opening being provided in the deflection surface at the side facing the second side wall of the first wall element of the first installation body, and a first wall element of the second installation body adjoining the second and third wall elements.

9. The mixing element in accordance with claim 1, wherein the second installation body has a first wall element extending in the direction of the longitudinal axis and has a first side wall and a second side wall which is arranged opposite the first side wall, the mixing element further comprising a deflection element arranged adjacent to the first wall element of the second installation body and the deflection element having a deflection surface extending in the transverse direction to the first wall element of the second installation body at both sides of the first wall element of the second installation body, a first opening being provided in the deflection surface at a side which faces the second side wall of the wall element of the second installation body, second and third wall elements are arranged adjacent to the first opening, the second and third wall elements extending in the direction of the longitudinal axis and each have an inner wall and an outer wall which extend substantially in the direction of the longitudinal axis, each of the inner walls and outer walls having an angle between 20° and 160° with one of the first and second side walls of the first wall element of the second installation body, the first opening being arranged between the inner walls of the second and third wall elements, a second opening being arranged outside one of the outer walls of the second or third wall elements, the second opening being provided in the deflection surface at the side which faces the second side wall of the first wall element of the second installation body, the second installation body containing the first wall element, the deflection element and the second and third wall elements are arranged rotated about the longitudinal axis by an angle of 10° up to and including 180° with respect to the first installation body.

10. The mixing element in accordance with claim 1, wherein the first and second installation bodies are part of more than five installation bodies connected to one another via a common bar element.

11. The mixing element in accordance with claim 1, wherein the first inlet passage is configured to be disposed only partially within the mixer housing.

12. A static mixer comprising:

a mixing element; and a tubular mixer housing surrounding the mixing element and having an inner wall, the mixing element including at least one first installation body and one second installation body arranged behind one another along a longitudinal axis of the mixing element; and an inlet element arranged upstream of the first installation body, the inlet element and the first installation body being integrally connected via a connection element, the inlet element having a body sealingly taken up peripherally in the tubular mixer housing, the body of the inlet element having a first inlet passage and a second inlet passage, the first inlet passage having a first entry opening and a first exit opening, the first exit opening being disposed in an outer surface of the body of the inlet element, the second inlet passage having a second entry opening and a second exit opening so that corresponding components can be conducted through the first inlet passage from the first entry opening to the first exit opening and through the second inlet passage from the second entry opening to the second exit opening, the first inlet passage extending spatially separately from the second inlet passage, the first inlet passage opening into a pre-chamber that is external to the body of the inlet element, and defined by the outer surface of the body of the inlet element, by the connection element, by the inner wall of the mixer housing and by the first installation body, the first inlet passage being upstream of the outer surface of the body and configured to be disposed within the mixer housing, the second inlet passage extending from the second exit opening into an inner space of the connection element such that a continuation passage opens into a mixing space of the first installation body from the inner space of the connection element, the pre-chamber and the inner space being separated by the connection element such that components in the pre-chamber are separated from components in the inner space, the inlet element includes a wall element separating the first exit opening from the second exit opening to maintain separation of the components in the pre-chamber and the inner space of the connection element, a ratio of a cross-sectional area of the continuation passage to a remaining free cross-sectional area being at most 1:4, the cross-sectional areas being taken on a sectional plane normal to the longitudinal axis and arranged at a mixer entry.

13. A method of mixing flowable components, comprising:

providing a mixing element for a static mixer for installation into a tubular mixer housing, the mixing element comprising at least one first installation body and one second installation body arranged behind one another along a longitudinal axis of the mixing element, and an inlet element arranged upstream of the first installation body, the inlet element and the first installation body being integrally connected via a connection element, the inlet element having a body configured to be sealingly taken up peripherally in a tubular mixer housing, the body of the inlet element having a first inlet passage and a second inlet passage, the first inlet passage having a first entry opening and a first exit opening, the first entry opening being disposed in a first outer surface of the body of the inlet element that extends transverse to the longitudinal axis of the mixing element, the first exit opening being disposed in a second outer surface of the body of the inlet element opposite the first outer surface and that extends transverse to the longitudinal axis of the mixing element, the first inlet passage extending through the body of the inlet element from the first entry opening to the first exit opening, the second inlet passage having a second entry opening and a second exit opening so that corresponding components can be conducted through the first inlet passage from the first entry opening to the first exit opening and through the second inlet passage from the second entry opening to the second exit opening, the first inlet passage extending spatially separately from the second inlet passage, the first inlet passage configured to open into a pre-chamber external to the body of the inlet element and that is defined by the second outer surface of the body of the inlet element, by the connection element, by an inner wall of the mixer housing and by the first installation body, the first inlet passage being upstream of the second outer surface of the body and configured to be disposed at least partially within the mixer housing, the second inlet passage extending from the second exit opening into an inner space of the connection element such that a continuation passage opens into a mixing space of the first installation body from the inner space of the connection element, the pre-chamber and the inner space being separated by the connection element such that components in the pre-chamber are separated from components in the inner space, the inlet element includes a wall element separating the first exit opening from the second exit opening to maintain separation of the components in the pre-chamber and the inner space of the connection element, a ratio of a cross-sectional area of the continuation passage to a remaining free cross-sectional area being at most 1:4, the cross-sectional areas being taken on a sectional plane normal to the longitudinal axis and arranged at a mixer entry; and operating a device to mix the flowable components with the mixing element.

14. The mixing element in accordance with claim 13, wherein the first inlet passage is configured to be disposed only partially within the mixer housing.

15. A method of mixing flowable components, comprising:

providing a mixing element for a static mixer for installation into a tubular mixer housing, the mixing element comprising at least one first installation body and one second installation body arranged behind one another along a longitudinal axis of the mixing element, and an inlet element arranged upstream of the first installation body, the inlet element and the first installation body being integrally connected via a connection element, the inlet element having a body configured to be sealingly taken up peripherally in a tubular mixer housing, the body of the inlet element having a first inlet passage and a second inlet passage, the first inlet passage having a first entry opening and a first exit opening, the first entry opening being disposed in a first outer surface of the body of the inlet element that extends transverse to the longitudinal axis of the mixing element, the first exit opening being disposed in a second outer surface of the body of the inlet element opposite the first outer surface and that extends transverse to the longitudinal axis of the mixing element, the first inlet passage extending through the body of the inlet element from the first entry opening to the first exit opening, the second inlet passage having a second entry opening and a second exit opening so that corresponding components can be conducted through the first inlet passage from the first entry opening to the first exit opening and through the second inlet passage from the second entry opening to the second exit opening, the first inlet passage extending spatially separately from the second inlet passage, the first inlet passage configured to open into a pre-chamber external to the body of the inlet element and that is defined by the second outer surface of the body of the inlet element, by the connection element, by an inner wall of the mixer housing and by the first installation body, the first inlet passage being upstream of the second outer surface of the body and configured to be disposed at least partially within the mixer housing, the second inlet passage extending from the second exit opening into an inner space of the connection element such that a continuation passage opens into a mixing space of the first installation body from the inner space of the connection element, the pre-chamber and the inner space being separated by the connection element such that components in the pre-chamber are separated from components in the inner space, the inlet element includes a wall element separating the first exit opening from the second exit opening to maintain separation of the components in the pre-chamber and the inner space of the connection element, a ratio of a cross-sectional area of the continuation passage to a remaining free cross-sectional area being at most 1:4, the cross-sectional areas being taken on a sectional plane normal to the longitudinal axis and arranged at a mixer entry; and operating a device to mix at least one of multicomponent adhesives, sealing materials and dental impression materials with the mixing element.

16. The mixing element in accordance with claim 15, wherein the first inlet passage is configured to be disposed only partially within the mixer housing.

* * * * *